US009688943B2

(12) United States Patent
Cen et al.

(10) Patent No.: US 9,688,943 B2
(45) **Date of Patent: *Jun. 27, 2017**

(54) CANDLE CONTAINING NON-IONIC EMULSIFER

(71) Applicant: beautyAvenues LLC, Reynoldsburg, OH (US)

(72) Inventors: Raymond Cen, New Albany, OH (US); Maureen Stanley, Blacklick, OH (US); Michael J. Regina, Ramsey, NJ (US); Catherine Arnold, Columbus, OH (US)

(73) Assignee: beauty Avenues LLC, Reynoldsburg, OH (US)

( * ) Notice: Subject to any disclaimer, the term of this patent is extended or adjusted under 35 U.S.C. 154(b) by 155 days.

This patent is subject to a terminal disclaimer.

(21) Appl. No.: 14/725,397

(22) Filed: May 29, 2015

(65) Prior Publication Data

US 2016/0348030 A1 Dec. 1, 2016

(51) Int. Cl.
*C11C 5/00* (2006.01)
*F23D 3/08* (2006.01)

(52) U.S. Cl.
CPC ..... *C11C 5/002* (2013.01); *C11C 5/004* (2013.01); *C11C 5/006* (2013.01); *F23D 3/08* (2013.01)

(58) Field of Classification Search
CPC ..... C11C 5/00; F23D 3/00; F23D 3/16; F23D 3/08
USPC ..... 431/288, 275; 44/265, 275; 424/401, 55
See application file for complete search history.

(56) References Cited

U.S. PATENT DOCUMENTS

| | | | |
|---|---|---|---|
| 3,615,289 | A | 10/1971 | Felton et al. |
| 4,105,539 | A | 8/1978 | Borst et al. |
| 4,151,304 | A | 4/1979 | Evans |
| 4,425,268 | A | 1/1984 | Cooper |
| 4,436,788 | A | 3/1984 | Cooper |
| 4,504,434 | A | 3/1985 | Cooper |
| 4,828,922 | A | 5/1989 | Koshizuka et al. |
| 5,137,786 | A | 8/1992 | Koshizuka et al. |
| 5,422,131 | A | 6/1995 | Elsen et al. |
| 5,451,416 | A | 9/1995 | Johnston et al. |

(Continued)

FOREIGN PATENT DOCUMENTS

| | | |
|---|---|---|
| CA | 2655367 | 8/2010 |
| CA | 2818752 | 5/2012 |

(Continued)

OTHER PUBLICATIONS

Rezaei et al., "Combustion Characteristics of Candles Made from Hydrogenated Soybean Oil," Dept of Food Science and Human Nutrition, and the Center for Crops Utilization Research, Iowa State University, Ames, IA, Journal Paper No. J-19568; Project No. 0178.

(Continued)

*Primary Examiner* — Gregory Huson
*Assistant Examiner* — Nikhil Mashruwala
(74) *Attorney, Agent, or Firm* — Fish & Richardson P.C.

(57) ABSTRACT

The disclosure relates to candles, including multi-wick candles, that contain one more non-ionic emulsifiers. The non-ionic emulsifier(s) can be contained in the candle base formulation and/or in the wick coating formulation. The candles exhibit one or more desirable properties, such as good flame height, good fragrance character, low mineral impurity levels and little or no discoloration.

29 Claims, 6 Drawing Sheets

(56) References Cited

U.S. PATENT DOCUMENTS

| | | | | |
|---|---|---|---|---|
| 5,567,420 | A | 10/1996 | McEleney et al. | |
| 6,022,402 | A | 2/2000 | Stephenson et al. | |
| 6,048,520 | A | 4/2000 | Hoshowski | |
| 6,106,597 | A | 8/2000 | Starks et al. | |
| 6,111,055 | A * | 8/2000 | Berger | A61K 8/042 424/64 |
| 6,153,209 | A | 11/2000 | Vega et al. | |
| 6,165,702 | A | 12/2000 | Smith et al. | |
| 6,383,505 | B1 | 5/2002 | Kaiser et al. | |
| 6,544,303 | B2 * | 4/2003 | Calzada | C11C 5/008 431/288 |
| 6,730,642 | B1 | 5/2004 | Aronson et al. | |
| 6,750,291 | B2 | 6/2004 | Kim et al. | |
| 6,797,020 | B2 | 9/2004 | Murphy | |
| 6,875,245 | B2 | 4/2005 | Pavlin | |
| 6,927,240 | B2 | 8/2005 | Schmid et al. | |
| 7,005,557 | B2 | 2/2006 | Klofta et al. | |
| 7,026,374 | B2 | 4/2006 | Nathan et al. | |
| 7,030,127 | B2 | 4/2006 | Nathan et al. | |
| 7,034,037 | B2 | 4/2006 | Arnold et al. | |
| 7,101,566 | B2 | 9/2006 | Rosenblatt et al. | |
| 7,255,870 | B2 | 8/2007 | Lennon et al. | |
| 7,588,607 | B1 | 9/2009 | Cap | |
| 7,637,968 | B2 | 12/2009 | Murphy | |
| 8,685,118 | B2 | 4/2014 | Murphy et al. | |
| 8,876,919 | B2 | 11/2014 | DiMaio et al. | |
| 8,911,515 | B2 | 12/2014 | Murphy et al. | |
| 9,458,411 | B2 * | 10/2016 | Murphy | C11C 5/023 |
| 2003/0003125 | A1 | 1/2003 | Nathan et al. | |
| 2003/0086958 | A1 | 5/2003 | Arnold et al. | |
| 2003/0165451 | A1 | 9/2003 | Lennon et al. | |
| 2003/0199644 | A1 | 10/2003 | Kim et al. | |
| 2003/0236310 | A1 | 12/2003 | Nathan et al. | |
| 2003/0236387 | A1 | 12/2003 | Pavlin | |
| 2004/0001890 | A1 | 1/2004 | Rosenblatt et al. | |
| 2004/0045546 | A1 | 3/2004 | Hirsh et al. | |
| 2004/0088907 | A1 | 5/2004 | Murphy | |
| 2005/0060927 | A1 | 3/2005 | Murphy | |
| 2005/0238691 | A1 | 10/2005 | Amold et al. | |
| 2006/0141004 | A1 | 6/2006 | Nathan et al. | |
| 2006/0141005 | A1 | 6/2006 | Nathan et al. | |
| 2006/0210747 | A1 | 9/2006 | Nathan et al. | |
| 2009/0004281 | A1 | 1/2009 | Nghiem et al. | |
| 2009/0087396 | A1 | 4/2009 | Hwang et al. | |
| 2009/0217568 | A1 | 9/2009 | Murphy et al. | |
| 2009/0258070 | A1 | 10/2009 | Burnier et al. | |
| 2010/0212214 | A1 * | 8/2010 | Wu | C11C 5/002 44/275 |
| 2010/0215605 | A1 | 8/2010 | Arditty et al. | |
| 2011/0009305 | A1 | 1/2011 | Somerville et al. | |
| 2012/0148966 | A1 * | 6/2012 | Ramaker | C11C 5/006 431/292 |
| 2013/0116633 | A1 * | 5/2013 | Lichty, II | A61M 25/0043 604/264 |
| 2014/0051722 | A1 | 2/2014 | Burnier et al. | |
| 2014/0144069 | A1 | 5/2014 | Murphy et al. | |
| 2014/0230314 | A1 * | 8/2014 | Murphy | C11C 5/023 44/275 |
| 2015/0010966 | A1 | 1/2015 | Lali et al. | |
| 2016/0103635 | A1 * | 4/2016 | Sugiyama | G06Q 20/209 705/24 |

FOREIGN PATENT DOCUMENTS

| | | |
|---|---|---|
| CA | 2899338 | 8/2014 |
| CN | 1271765 | 11/2000 |
| JP | 2004168796 | 6/2004 |

OTHER PUBLICATIONS

Hamins et al., "Characterization of Candle Flames," Journal of Fire Protection Engineering, vol. 15, Nov. 2005, pp. 265-285.

The Canadian Office Action for corresponding CA Appl No. 2928903, dated Mar. 27, 2017.

* cited by examiner

Dose Response of Emulsifier in Wick Coating Wax

Flame Height Enhancement

CANDLE CONTAINING NON-IONIC EMULSIFER

FIELD

The disclosure relates to candles, including multi-wick candles, containing one or more non-ionic emulsifiers. The non-ionic emulsifier(s) can be contained in the candle base formulation and/or in the coated candle wick composition.

BACKGROUND

Typically, a candle is formed of a base wax and at least one wick.

SUMMARY

The disclosure provides candles, particularly multi-wick candles, that exhibit both good flame height, e.g., enough flame height to be aesthetically pleasing but not so high as to present a potential danger, as well as sufficient fragrance strength to fill a large space in a house with a pleasing hedonic character. Desirably, the candles also exhibit good color stability, and/or low levels of mineral impurities.

The inventors realized that including an appropriate amount of one or more non-ionic emulsifiers in the candle results in a candle that can, for example, have multiple (e.g., three) wicks, while still exhibiting desirable flame height and fragrance properties. The non-ionic emulsifier(s) can be present in the candle base formulation, the wick coating wax formulation, or both. Further, the inventors realized that this approach to formulating high quality candles can be implemented with little or no impact on the process used to manufacture the candle. In addition, the inventors realized that including the non-ionic emulsifier(s) can have little impact on the cost of manufacturing the candle. Optionally, a candle disclosed herein can be manufactured by a method in which one or more fragrance components are mixed with the emulsifier before being added to the base wick coating formulation.

Without being bound by theory, it is believed that using an appropriate amount of non-ionic emulsifier with an appropriate hydrophilic-lipophilic balance ("HLB") can improve capillary suction, e.g., on one or more burning wicks, help to disperse trace of polar impurities and/or crystalline materials, and improve compatibility of different constituents of a candle composition, including fragrance in the candle base, resulting in enhanced burning efficiency. For example, the candle can exhibit a higher but not too high flame height, a narrower flame height distribution and a desirably fast rate of consumption. At the same time, the candle can maintain desirable fragrance properties, whether in use at elevated temperature due to candle flame(s) or not in use and at, for example, room temperature.

In addition, the inventors surprisingly realized that it may not be enough to identify an appropriate non-ionic emulsifier solely based on the chemical properties of the emulsifier itself, but that the purity of the non-ionic emulsifier can have a significant impact on candle performance, particularly as it relates to flame height and fragrance delivery. For example, the inventors have realized that the ability of a multi-wick candle to exhibit performance can be dramatically improved if the non-ionic emulsifier has a low water content and/or impurities equivalent to a low ash level.

In one exemplary aspect, the disclosure provides a candle that includes at least one non-ionic emulsifier, wherein the candle has a minimum mean flame height of at least one quarter inch (e.g., one half inch). The candle can have a maximum mean flame height of at most three inches (e.g., at least two inches).

An appropriate non-ionic emulsifier can have an HLB of from one to nine, such as from two to six. The non-ionic emulsifier can include a hydrophobic tail having at least 10 carbon atoms (e.g., at least 15 carbon atoms) and/or at most 50 carbon atoms (e.g., at most 25 carbon atoms). The non-ionic emulsifier can be completely dispersed in candle wax at a temperature between 25° C. and 100° C. Notwithstanding the foregoing, in some embodiments the non-ionic emulsifier may not have each of these characteristics. As an example, ethylene oxide/propylene oxide copolymers with different ratios can be used to achieve an appropriate non-ionic emulsifier having a desired HLB.

Exemplary non-ionic emulsifiers include ethoxylated aliphatic alcohols, polyoxyethylene surfactants, carboxylic esters, polyethylene glycol esters, anhydrosorbital esters, derivatives of anhydrosorbitol esters, glycol esters of fatty acids, carboxylic amides, monoalkanoamine condensates and polyoxyethylene fatty acid amines. For example, the non-ionic emulsifier can include fatty alcohols, cetyl alcohols, stearyl alcohols, cetostearyl alcohols, oleyl alcohols, polyoxyethylene glycol alkyl ethers (Brij), polyoxypropylene glycol alkyl ethers, glucoside alkyl ethers, polyoxyethylene glycol octylphenol ethers, polyoxyethylene glycol alkylphenol ethers, glycerol alkyl esters, polyoxyethylene glycol sorbitan alkyl esters, sorbitan alkyl esters, cocamide MEAs, cocamide DEAs, dodecyldimethylamine oxides, block copolymers of polyethylene glycol, and polypropylene glycol.

The non-ionic emulsifier can include less than one weight percent water, and/or the non-ionic emulsifier can include impurities equivalent to less than 0.5 weight percent ash.

The candle can have substantially the same fragrance character as an otherwise identical candle without the non-ionic emulsifier, whether determined at room temperature or at elevated temperature (e.g., during use of the candle).

The candle can have more than one wick. For example, the candle can have two wicks, three wicks, four wicks, five wicks, six wicks, seven wicks, eight wicks, nine wicks or 10 wicks.

In general, the candle can include a candle base and a wick. The candle base can be formed of a candle base formulation that includes at least one wax, at least one fragrance component, and at least one non-ionic emulsifier. Optionally, the candle base can further include at least one colorant. The wick can be formed of a material having desired capillary properties that allow the melted wick wax to move up the wick via capillary suction during use of the candle, such as a braided or knitted material, and a wick coating formulation that includes at least one wax and at least one non-ionic emulsifier. In some cases, only the candle base formulation includes non-ionic emulsifier(s). In certain cases, only the wick coating formulation includes non-ionic emulsifier(s). Optionally, both the wick coating formulation and the candle base formulation include one or more non-ionic emulsifiers. A non-ionic emulsifier in the candle base formulation can be the same as or different from a non-ionic emulsifier in the wick coating formulation. The wax(es) in the candle base formulation may be the same as or different from the wax(es) in the wick coating formulation.

In embodiments in which the candle base formulation contains at least one fragrance component, the fragrance component(s) may be combined with the non-ionic emulsifier(s), and the combination of non-ionic emulsifier(s) and fragrance component(s) may be subsequently combined with the wax(es).

As an example, in some embodiments, the candle includes a candle base formulation and a wick, wherein the wick includes a member having appropriate capillary properties, such as a braided or knitted material, and a wick coating formulation. The candle base formulation can include at least a first wax and at least one non-ionic emulsifier. The wick coating formulation can include at least a second wax which is different from the first wax, and the wick coating formulation can include at least a second non-ionic emulsifier which is different from the non-ionic emulsifier in the candle base formulation. The second wax is at least partially disposed on the member with desired capillary properties, and the second wax is in the member with desired capillary properties.

As another example, in certain embodiments, the candle includes a candle base formulation and a wick, wherein the wick includes a member with desired capillary properties and a wick coating formulation. The candle base formulation includes at least one wax, at least one fragrance, and at least one non-ionic emulsifier. The wick coating formulation includes the wax and at least a second non-ionic emulsifier which is different from the non-ionic emulsifier in the candle base formulation. The wax of the wick coating formulation is at least partially disposed on the member and in the member.

As a further example, in some embodiments, the candle includes a candle base formulation, at least one fragrance component, and a wick, wherein the wick includes a member with desired capillary properties and a wax. The candle base formulation includes a wax and a non-ionic emulsifier. The wick coating formulation includes the wax at least partially disposed on the member and in the member. The wick coating formulation also includes the non-ionic emulsifier(s).

In some embodiments, the candle base formulation includes at most five weight percent of the non-ionic emulsifier(s). For example, the candle base formulation can include from 0.1 weight percent of the non-ionic emulsifier(s) to one weight percent of the non-ionic emulsifier(s) (e.g., from 0.2 weight percent of the non-ionic emulsifier(s) to one weight percent of the non-ionic emulsifier(s), 0.5 weight percent of the non-ionic emulsifier(s)).

In another exemplary implementation, the disclosure provides a candle that includes at least one non-ionic emulsifier, wherein the candle has a minimum mean flame height that is at least 0.1 inch higher (e.g., at least 0.2 inch higher) than that of an otherwise identical candle without the non-ionic emulsifier. The candle can have a maximum flame height that is at most one inch higher than that of an otherwise identical candle without the non-ionic emulsifier.

In a further exemplary implementation, the disclosure provides a candle wick that includes a member with desired capillary properties and a candle wick coating formulation, which includes at least one wax and at least one non-ionic emulsifier. The wax is at least partially disposed on the member and in the member. The candle wick coating formulation can include at least five weight percent (e.g., at least 10 weight percent, at least 25 weight percent) of the non-ionic emulsifier(s). The candle wick coating formulation can include at most 50 weight percent of the non-ionic emulsifier(s). In some embodiments, a candle includes such a wick. In certain embodiments, a candle includes a plurality of (e.g., two, three, four, five, six, seven, eight, nine, 10) such wicks.

In another exemplary implementation, the disclosure provides a candle that includes a candle base formulation which includes at least one wax and at least one non-ionic emulsifier, wherein the candle base formulation includes at most one weight percent of the non-ionic emulsifier(s). The candle base formulation can include at least 0.1 weight percent (e.g., at least 0.2 weight percent) of the non-ionic emulsifier(s). For example, the candle base formulation can include from 0.2 weight percent of the non-ionic emulsifier(s) to 0.8 weight percent of the non-ionic emulsifier(s), such as 0.5 weight percent of the non-ionic emulsifier(s). The candle includes one or more (e.g., two, three, four, five, six, seven, eight, nine, 10) wicks.

Various embodiments are disclosed herein. It is understood that such embodiments are only exemplary in nature. It is also understood that aspects of embodiments can be combined in various manners as appropriate.

BRIEF DESCRIPTION OF THE DRAWINGS

Embodiments of the disclosure are described below with the aid of drawings, in which.

DETAILED DESCRIPTION

Figure 1:
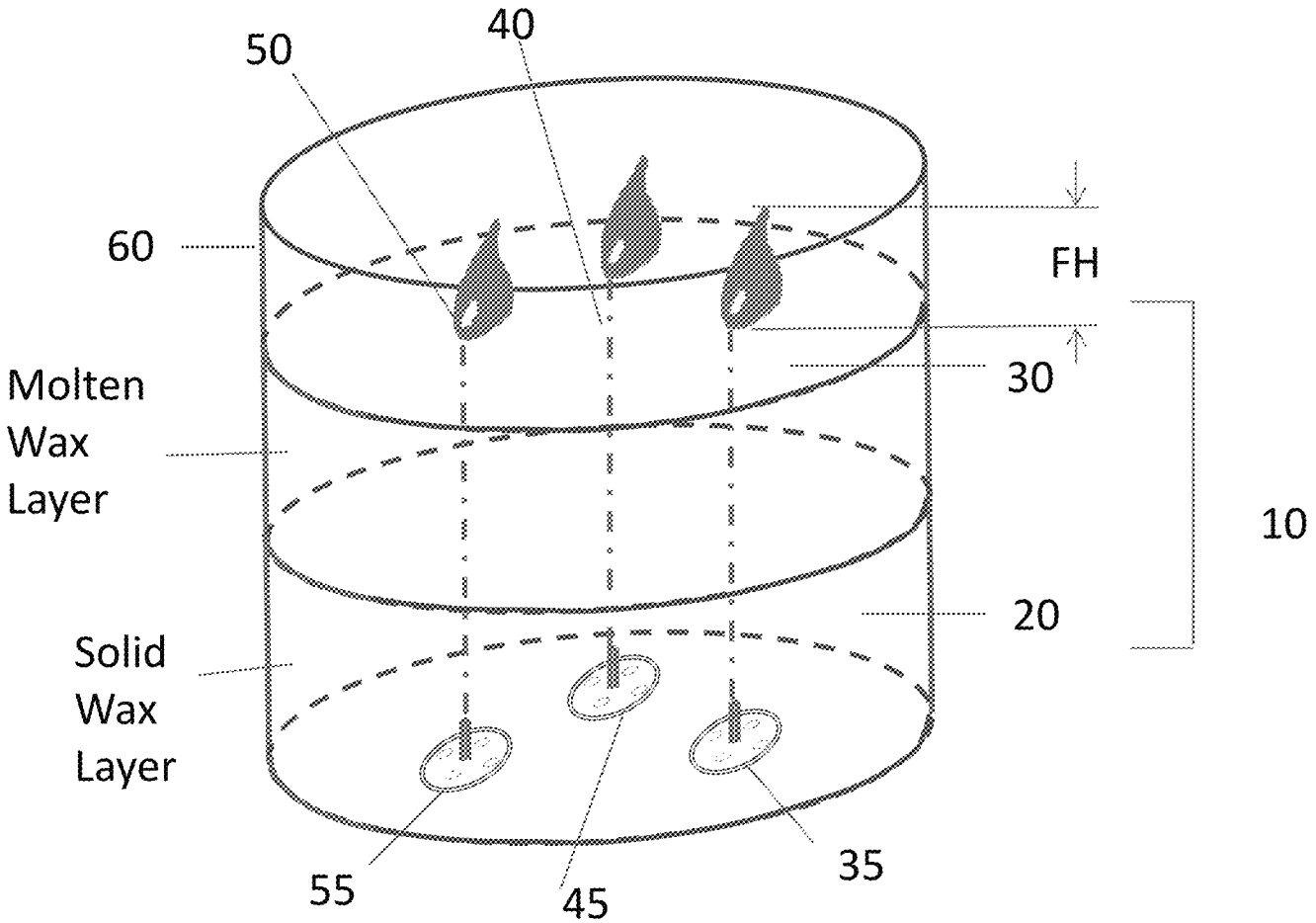
FIG. 1 depicts an exemplary three-wick candle.

FIG. 1 schematically depicts a candle 10 including a candle base 20 and wicks 30, 40 and 50. The candle 10 is in a container 60, and wicks 30, 40 and 50 are attached, e.g., glued, to stands 35, 45 and 55, respectively. The wicks are depicted as burning with flames having a flame height ("FH").

Candle Base Formulation

In general, the candle base 20 is formed of a candle base formulation that includes a wax, a fragrance component, a colorant and a non-ionic emulsifier. Optionally, the candle base formulation can contain, for example, one or more anti-oxidants, one or more UV protectants, and/or one or more flame retardants. Commonly, these optional components are present in relatively low concentrations, e.g., trace amounts.

Generally, the candle 10 provides a combination of desirable candle properties, including, for example, good flame height, good fragrance character, low mineral impurity properties, and good color stability. It can be particularly beneficial for the candle 10 to exhibit a combination of good flame height, e.g., high enough flame height to be aesthetically pleasing but not so high as to present a potential danger, and good fragrance character.

In some embodiments, the candle 10 has a minimum mean flame height of at least one quarter inch (e.g., at least one half inch, at least three quarters of an inch), and/or the candle 10 has a maximum flame height of at most three inches (e.g., at least most inches). As used herein, mean flame height refers to the mean height of a flame (e.g., as measured using a ruler, or any other appropriate measurement tool) for each wick as each wick of the candle burns for a continuous a four hour time period. Thus, for example, a three-wick candle having a minimum mean flame height of at least one quarter of an inch means that, as each of the three wicks simultaneously burns for a continuous four hour period, the flame of each wick is measured (e.g., using a ruler) as having a mean height of at least one quarter of an inch.

In general, the non-ionic emulsifier has can have an HLB of from one to nine, such as from two to six. Typically, the non-ionic emulsifier has a hydrophobic tail having at least 10 carbon atoms (e.g., at least 15 carbon atoms) and/or at most 50 carbon atoms (e.g., at most 25 carbon atoms). In some embodiments the non-ionic emulsifier may not have each of these characteristics. As an example, ethylene oxide/propylene oxide copolymers with different ratios can be used to achieve an appropriate non-ionic emulsifier having a desired HLB.

Desirably, the non-ionic emulsifier is readily dispersed in the candle base formulation (or in the wick coating formulation, see discussion below) under standard candle manufacturing conditions. For example, in certain embodiments, the non-ionic emulsifier can be completely dispersed in an appropriate candle wax at a temperature between 25° C. and 100° C.

In general, the amount of the non-ionic emulsifier contained in the candle base formulation can be varied based on desired properties for the candle. In some embodiments, the candle base formulation includes at most five weight percent of the non-ionic emulsifier. For example, the candle base formulation can include from 0.1 weight percent of the non-ionic emulsifier to one weight percent of the non-ionic emulsifier (e.g., from 0.2 weight percent of the non-ionic emulsifier to one weight percent of the non-ionic emulsifier, 0.5 weight percent of the non-ionic emulsifier).

In another exemplary implementation, the disclosure provides a candle that includes a non-ionic emulsifier, wherein the candle has a minimum mean flame height that is at least 0.1 inch higher (e.g., at least 0.2 inch higher) than that of an otherwise identical candle without the non-ionic emulsifier. The candle can have a maximum flame height that is at most one inch higher than that of an otherwise identical candle without the non-ionic emulsifier.

In many instances, it is preferable for the non-ionic emulsifier to have a relatively high purity. As an example, prior to incorporation into the candle base formulation (or the wick coating formulation, see discussion below), the non-ionic emulsifier can contain relatively little water and/or relatively low levels of mineral impurities. In some embodiments, the non-ionic emulsifier contains less than one weight percent water, and/or impurities equivalent to less than 0.5 weight percent ash.

Exemplary non-ionic emulsifiers include ethoxylated aliphatic alcohols, polyoxyethylene surfactants, carboxylic esters, polyethylene glycol esters, anhydrosorbital esters, derivatives of anhydrosorbitol esters, glycol esters of fatty acids, carboxylic amides, monoalkanoamine condensates and polyoxyethylene fatty acid amines. For example, the non-ionic emulsifier can include fatty alcohols, cetyl alcohols, stearyl alcohols, cetostearyl alcohols, oleyl alcohols, polyoxyethylene glycol alkyl ethers (Brij), polyoxypropylene glycol alkyl ethers, glucoside alkyl ethers, polyoxyethylene glycol octylphenol ethers, polyoxyethylene glycol alkylphenol ethers, glycerol alkyl esters, polyoxyethylene glycol sorbitan alkyl esters, sorbitan alkyl esters, cocamide MEAs, cocamide DEAs, dodecyldimethylamine oxides, block copolymers of polyethylene glycol, and polypropylene glycol.

A non-limiting list of non-ionic emulsifiers includes glycol distearate (HLB=1), sorbitan trioleate (HLB=1.8), propylene glycol isostearate (HLB=2.5), glycol stearate (HLB=2.9), Ppolyoxyethylene (HLB=6), sorbitan hexastearate (HLB=3.0), linear fatty alcohol C12-C14ethoxylates EO 0.8 mole (HLB=3.1), sortitan sesquioleate (HLB=3.7), glyceryl stearate (HLB=3.8), lecithin (HLB=4.0), linear fatty alcohol C12-C14ethoxylates EO 1.3 mole (HLB=4.0), castor oil ethoxylate EO 5 mole (HLB=4.0), 2,4,7,9-tetramethyl-5-decyne-4,7-diol, mixture of (±) and meso 98% (HLB=4), Brij® 93 average Mn ~357 (HLB=4), sorbitan oleate (HLB=4.3), castor oil ethoxylate EO 6 mole (HLB=4.5), sorbitan sesquioleate (HLB=4.5), sorbitan monostearate NF (HLB=4.7), linear fatty alcohol C16-C18 ethoxylates EO 2 mole (HLB=5.0), nonylphenol ethoxylates EO 2 mole (HLB=5.7), linear fatty alcohol C16-C18 ethoxylates EO 2.4 mole (HLB=5.7), linear Fatty alcohol C12-C14 ethoxylates EO 1.8 mole (HLB=5.8), sorbitan stearate (HLB=4.7), sorbitan isostearate (HLB=4.3 to 4.7), steaeth-2 (HLB=4.9), oleth-2 (HLB=4.9), glyceryl laurate (HLB=5.2), ceteth-2 (HLB=5.3), PEG-30 dipolyhydroxystearate (HLB=5.5), glyceryl steatate SE (HLB=5.8), sorbitan stearate (and) sucrose cocoate (HLB=6), PEG-4 dilaurate (HLB=6), linear fatty alcohol C12-C14 ethoxylates EO 2 mole (HLB=6.0), branched fatty alcohol C13-C15 ethoxylates EO 2 mole (HLB=6.0), hydrogenated castor oil ethoxylate 5 mole (HLB=6.0), MERPOL® A surfactant (HLB=6), linear fatty alcohol C12-C16 ethoxylates EO 2 mole (HLB=6.2), methyl glucose sesquistearte (HLB=6.6), lecithin (HLB variable), PEG-8 dioleate (HLB=8), sorbitan laurate HLB=8.6), PEG-40 sorbitan peroleate (HLB=9), ethylenediamine tetrakis(ethoxylate-block-propoxylate) tetrol average Mn~7,200 (HLB=1.0 to 7.0), ethylenediamine tetrakis(propoxylate-block-ethoxylate) tetrol average Mn~3,600 (HLB=1.0 to 7.0), poly(ethylene glycol)-block-poly(propylene glycol)-block-poly(ethylene glycol) average Mn~1,100 (HLB=1.0 to 7.0), poly(ethylene glycol)-block-polypropylene glycol)-block-poly(ethylene glycol) average Mn~2,000 (HLB=1.0 to 7.0), Poly(ethylene glycol)-block-poly(propylene glycol)-block-poly(ethylene glycol) average Mn~4,400 (HLB=1.0 to 7.0), poly(propylene glycol)-block-poly(ethylene glycol)-block-poly(propylene glycol) average Mn~3,300 (HLB=2.0 to 7.0), hydrogenated castor oil ethoxylate 10 mole (HLB=6.5), castor oil ethoxylate EO 10 mole (HLB=6.5), sorbitan palmitate (HLB=6.7), linear fatty alcohol C12-C14 ethoxylates EO 2.2 mole (HLB=6.9), branched fatty alcohol C9-C11 ethoxylates EO 2 mole (HLB=7.0), nonylphenol ethoxylates EO 3 mole (HLB=7.0), linear fatty alcohol C10 ethoxylates EO 2 mole (HLB=7.2), castor oil ethoxylate EO 13 mole (HLB=7.5), branched fatty alcohol C13-C15 ethoxylates EO 3 mole (HLB=7.7), branchedfFatty alcohol C12-C15 ethoxylates EO 3 mole (HLB=7.8), Branched Fatty alcohol C9-C11 ethoxylates EO 2.5 mole (HLB=8.1), branched fatty alcohol C13 ethoxylates EO 3 mole (HLB=8.1), linear fatty alcohol C12-C14 ethoxylates EO 3 mole (HLB=8.1), branched fatty alcohol C8 ethoxylates EO 2 mole (HLB=8.3), oleic acid ethoxylate EO 4.5 mole (HLB=8.5), polyoxyethylene (6) sorbitan tetraoleate (HLB=8.5), castor oil ethoxylate EO 15 mole (HLB=8.5), branched fatty alcohol C11 ethoxylates EO 3 mole (HLB=8.7), nonylphenol ethoxylates EO 4 mole (HLB=8.9), branched fatty alcohol C16-C18 ethoxylates EO 5 mole (HLB=9.0), branched fatty alcohol C13 ethoxylates EO 4 mole (HLB=9.0), linear fatty alcohol C16-C18 ethoxylates EO 5 mole (HLB=9.0), linear fatty alcohol C12-C16 ethoxylates EO 3 mole (HLB=8.0), and poly(ethylene glycol)-block-poly(propylene glycol)-block-poly(ethylene glycol) average Mn~5,800 (HLB=7.0 to 9.0).

Additional examples of appropriate non-ionic emulsifiers are disclosed in, for example, the sections of the following two books that discuss non-ionic emulsifiers, which sections are incorporated by reference herein in their entirety: M. R. Porter, *Handbook of Surfactants* (1994), ISBN-13: 978-0751401707 (print) ISBN-10: 0751401706 (online), $2^{nd}$ Edition: $2^{nd}$ edition; and M. R. Porter, *Handbook of Surfactants* ISBN: 978-1-4757-1295-7 (print) 978-1-4757-1293-3 (online).

Generally, the amount of wax contained in the candle base formulation can vary depending on the particular desired properties of the wax. In general, the candle base formulation includes commercially typical amounts of the wax. For example, the candle base formulation can contain from 85 weight percent to 95 weight percent (e.g., 90 weight percent) of the wax. In some embodiments, the candle base formulation can include more than one wax. In such embodiments, the total amount of wax contained in the candle base formulation can be within the ranges noted earlier in this paragraph.

In general, the wax used in the candle base formulation can be selected based on the desired properties of the candle 10. Typically, a commercially standard wax material can be used. Exemplary waxes that can be used in the candle base formulation include partially hydrogenated vegetable oil, paraffin, micro-crystalline wax. As an example, in some embodiments, the total amount of wax in the candle base formulation can be formed of 50 weight percent to 70 weight percent of partially hydrogenated vegetable oil, and from 30 weight percent to about 50 paraffin.

Typically, the amount of fragrance component contained in the candle base formulation can vary depending on the particular desired properties of the wax. In general, the candle base formulation includes commercially typical amounts of the wax. For example, the candle base formulation can contain from one weight percent to 25 weight percent of the fragrance components. In some embodiments, the candle base formulation can include more than one fragrance component. In such embodiments, the total amount of fragrance component contained in the candle base formulation can be within the ranges noted earlier in this paragraph.

Wick

For each of wicks 30, 40 and 50, the wick is typically formed of a member that allows the melted wick wax to move up the wick via capillary suction during use of the candle, such as a braided or knitted material. The wick also includes a wick coating formulation that is at least partially disposed on the member and in the member. In general, the wick coating formulation includes a wax and a non-ionic emulsifier. Optionally, the candle wick coating formulation can contain, for example, other ingredients, such as one or more anti-oxidants, one or more UV protectants, and/or one or more flame retardants.

The non-ionic emulsifier present in the wick coating formulation has the same general properties noted above with respect to the non-ionic emulsifier present in the candle base formulation, and the non-ionic emulsifier present in the wick coating formulation can be selected from the list of non-ionic emulsifiers provided above in the discussion of the candle base formulation.

Optionally, a non-ionic emulsifier present in the wick coating formulation is identical to a non-ionic emulsifier present in the candle base formulation. In some embodiments, however, a non-ionic emulsifier present in the candle base formulation is different from a non-ionic emulsifier present in the wick coating formulation.

In general, the relative amount of non-ionic emulsifier present in the wick coating formulation can be large compared to the relative amount of non-ionic emulsifier present in the candle base formulation. For example, the wick coating formulation can contain at least five weight percent (e.g., at least 10 weight percent, at least 25 weight percent) of the non-ionic emulsifier. In some embodiments, the wick coating formulation contains at most 50 weight percent (e.g., at most 40 weight percent) of the non-ionic emulsifier.

In general, the wax present in the wick coating formulation is different from the wax used in the candle base formulation. Typically, the wax contained in the wick coating formulation is a long chain paraffin material with a sufficiently high melting point. Generally, the melting point is such that the wick stands up even when candle is hot enough to form a molten wax pool.

The member of the wick which provides the property of allowing the molten wax to move up the wick via capillary suction during use of the candle may be, for example, a braided material or a knitted material. Such a braided or knitted material can be selected from, for example, commercially available braided and knitted materials for wicks. Exemplary materials from which the member is made include cotton and paper. Typically, a braided material surrounds a solid core material (e.g., metal-containing material, polymer, paper) that may be in the form of a ribbon or other shapes. Optionally, natural materials (e.g., wood) and/or synthetic materials can be used as wick materials.

Methods of Manufacture

In general, known methods for manufacturing candles can be used to provide the candles disclosed herein. Typically, high melting point wax coated wicks are cut into a desired length then crimped into small metal wick stands. The wick stands are attached to the bottom of a container. On top of the container, a metal wick guide is placed to keep the wicks vertical. The base candle formulation is poured into the container to the desired level. The candle is cooled to room temperature, followed by removal of the metal wick guide. Optionally, an accelerated cooling process can be used. The wicks are trimmed to right length to yield a finished candle. Other approaches, including those common in the industry, may be used.

EXAMPLES

Example 1

The specific candle wax compositions tested are set forth in Table 1 below. Each candle wax composition contained the same weight percent of a fragrance component (Frag.). The commercial names for the fragrance components listed in Table 1 are as follows: Fresh Balsam (FB): Leaves (L); Japanese Cherry Blossom (JCB); Beach Cabana (BC); and Winter (W). The candle wax compositions in Table 1 also included 0.50% by weight of the specified non-ionic emulsifier component, except for those compositions identified as a single blank. The single blank represents a control formulation comprising the selected fragrance component in the absence of an emulsifier component. Table 1 provides the measured mean flame height data for each formulation tested. As demonstrated by the data in Table 1, the mean flame height can be increased or decreased relative to the control depending on the non-ionic emulsifier component selected.

TABLE 1

| Test No. | Non-Ionic Emulsifier | Non-Ionic Emulsifier weight % | HLB | Fra-grance | Mean FH (inch) |
|---|---|---|---|---|---|
| 1 | Single Blank (Control) | 0.00 | N/A | FB | 1.28 |
| 2 | 85:15 Span 60/Span 40 | 0.50 | 5.0 | FB | 1.35 |
| 3 | Hexadecanol | 0.50 | 1.0 | FB | 1.26 |
| 4 | SPAN 80 | 0.50 | 4.3 | FB | 1.11 |
| 5 | 82:18 Tergitol L61/L62 | 0.50 | 3.7 | FB | 1.08 |
| 6 | 50:50 Tergitol L61/L62 | 0.50 | 5.0 | FB | 1.03 |
| 7 | Steareth-2 | 0.50 | 4.9 | FB | 0.92 |
| 8 | Oleth-2 | 0.50 | 4.9 | FB | 0.86 |
| 9 | Ceteth-2 | 0.50 | 5.3 | FB | 0.78 |
| 10 | 71:29 SPAN 65/SPAN 80 | 0.50 | 3.7 | FB | 0.42 |
| 11 | Single Blank (Control) | 0.00 | N/A | L | 1.10 |
| 12 | SPAN 80 | 0.50 | 4.3 | L | 1.36 |
| 13 | Single Blank (Control) | 0.00 | N/A | JCB | 0.46 |
| 14 | SPAN 80 | 0.50 | 4.3 | JCB | 0.88 |
| 15 | SPAN 80 | 0.50 | 4.3 | W | 1.24 |
| 16 | SPAN 80 | 0.50 | 4.3 | BC | 0.71 |

Figure 2:
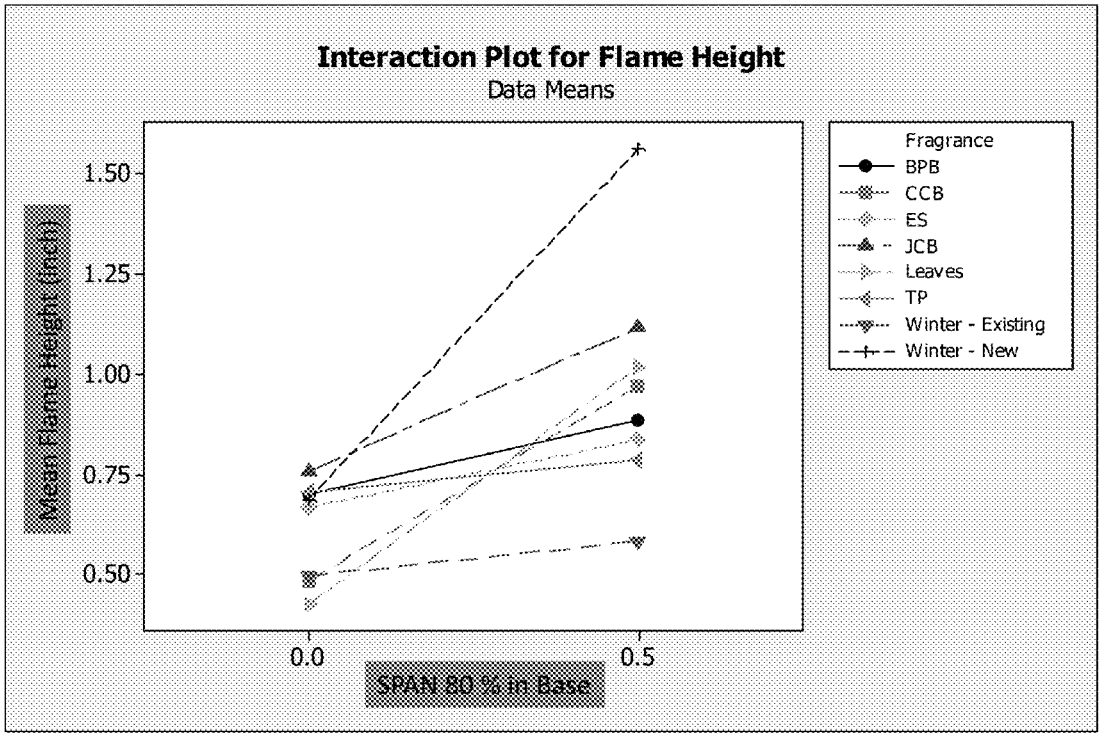
FIG. 2 shows data for the impact of the non-ionic emulsifier on mean flame height for different candle compositions.

FIG. 2 shows the effect on the mean flame height (delta flame height) for those samples containing the SPAN 80 as the non-ionic emulsifier. In FIG. 2, "mean" represents mean flame height. As shown in FIG. 2, the addition of 0.50% by weight of SPAN 80 in the candle wax with a fragrance component increases the mean flame height in all tested candles.

Example 2

Formulations containing either Leaves or Japanese Cherry Blossom as the fragrance component were tested to investiage mean flame height as a function of the relative amount of non-ionic emulsifier contained in the candle wick coating formulation and in the base candle formulation.

Figure 3:
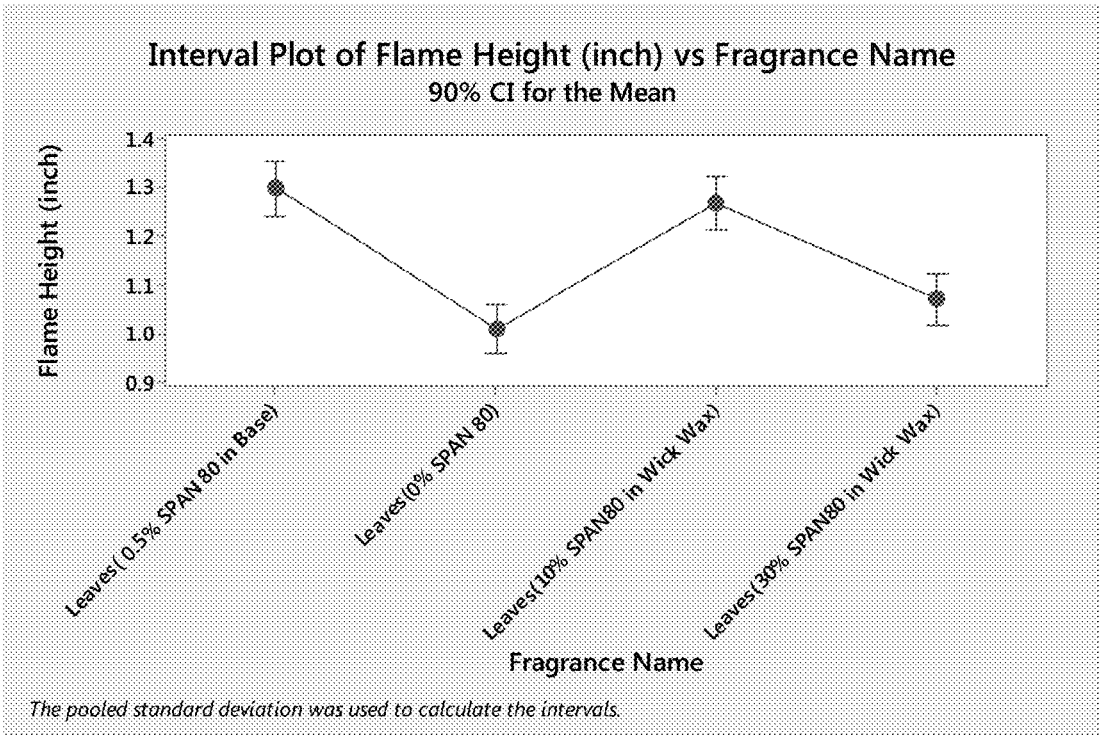
FIG. 3 shows data for 3-wick candles with Leaves fragrance.

FIG. 3 shows data for the candles containing Leaves fragrance. In FIG. 3, the mean flame height is shown for four different candles: 1) candle wick coating formulation containing no non-ionic emulsifier and candle base formulation containing 0.5% non-ionic emulsifier; 2) candle wick coating formulation containing no non-ionic emulsifier and candle base formulation containing no non-ionic emulsifier; 3) candle wick coating formulation containing 10% non-ionic emulsifier and candle base formulation containing no non-ionic emulsifier; and 4) candle wick coating formulation containing 30% non-ionic emulsifier and candle base formulation containing no non-ionic emulsifier.

FIG. 3 shows that adding more non-ionic emulsifier to the candle wick coating formulation does not always increase the mean flame height of the candle. Rather, there is an optimum level of non-ionic emulsifier that can be used in the candle wick coating formulation to provide desired flame height properties.

FIG. 3 also shows that comparable flame height characteristics can be achieved by disposing a relatively high percentage dosage of non-ionic emulsifier in the candle wick coating formulation or by using a relatively small percentage dosage of non-ionic emulsifier in the candle base formulation. However, on a per candle basis, the absolute amount of non-ionic emulsifier used in the wick coating formulation is substantially less than the amount of non-ionic emulsifier added to the candle base formulation.

Figure 4:
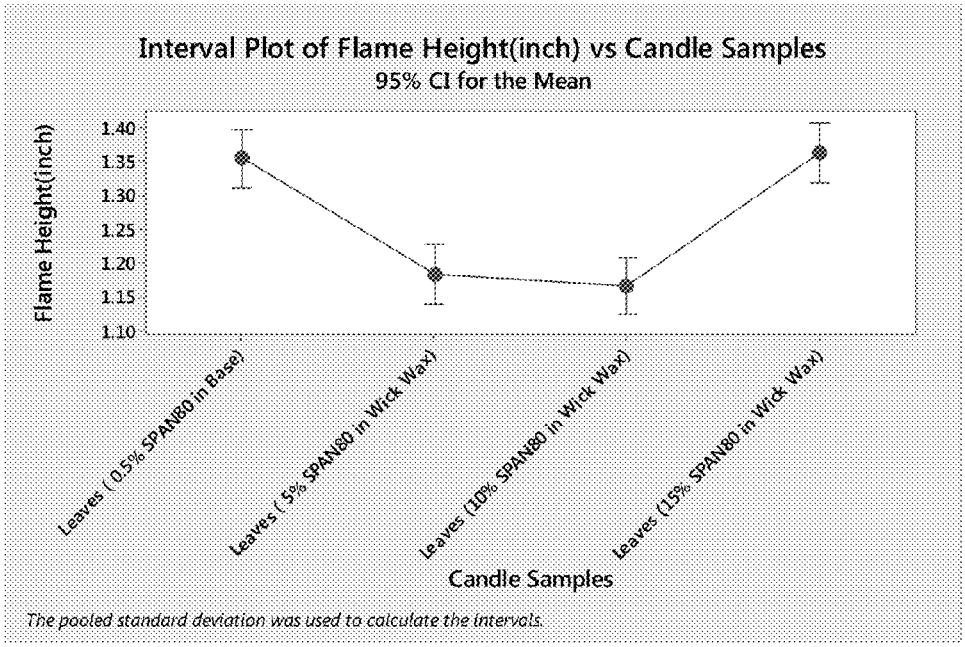
FIG. 4 shows data for 3-wick candles with Leaves fragrance.

FIG. 4 also shows data for candles containing Leaves as the fragrance component. In FIG. 4, the mean flame height is shown for four different candles: 1) candle wick coating formulation containing no non-ionic emulsifier and candle base formulation containing 0.5% non-ionic emulsifier; 2) candle wick coating formulation containing 5% non-ionic emulsifier and candle base formulation containing no non-ionic emulsifier; 3) candle wick coating formulation containing 10% non-ionic emulsifier and candle base formulation containing no non-ionic emulsifier; and 4) candle wick coating formulation containing 15% non-ionic emulsifier and candle base formulation containing no non-ionic emulsifier.

The data in FIG. 4, particularly when combined with the data in FIG. 3, reinforces the observation that comparable flame height characteristics can be achieved by disposing a relatively high percentage dosage of non-ionic emulsifier in the candle wick coating formulation or by using a relatively small percentage dosage of non-ionic emulsifier in the candle base formulation.

The data in FIG. 4, particularly when combined with the data in FIG. 3, reinforces the observation that that adding more non-ionic emulsifier to the candle wick coating formulation does not always increase the mean flame height of the candle, and that there is instead an optimum level of non-ionic emulsifier that can be used in the candle wick coating formulation to provide desired flame height properties.

Figure 5:
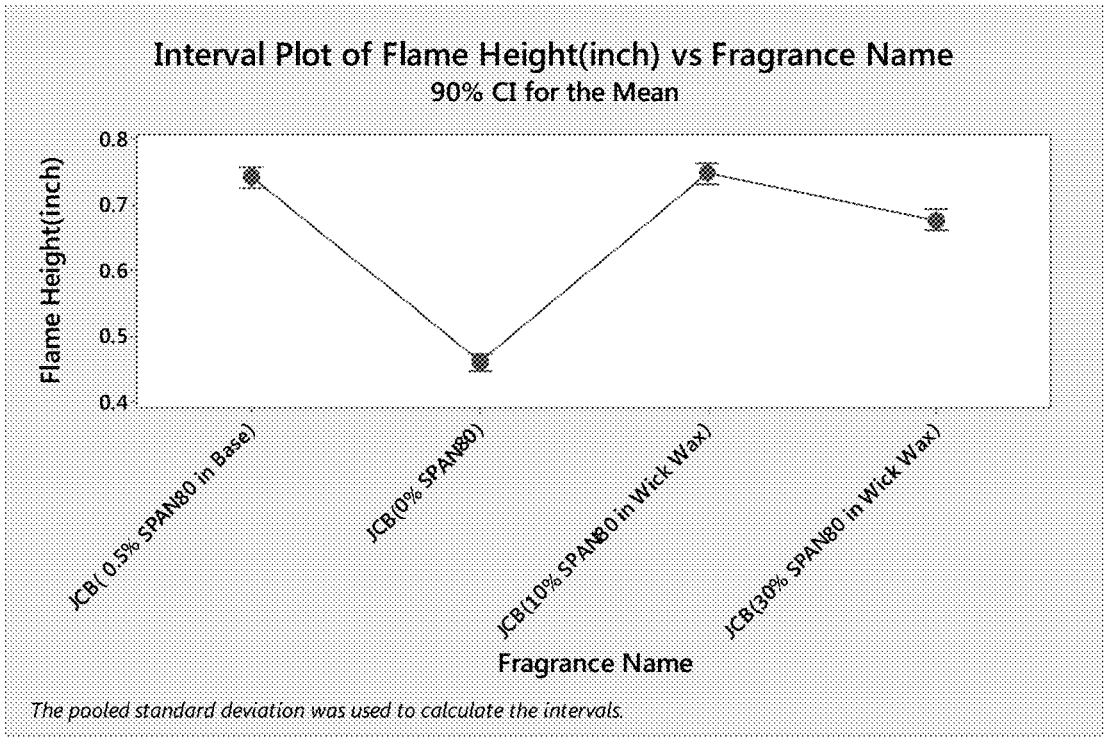
FIG. 5 shows data for 3-wick candles with Japanese Cherry Blossom fragrance.

FIG. 5 shows data for candles containing that Japanese Cherry Blossom fragrance. In FIG. 5, the mean flame height is plotted against four different candles: 1) candle wick coating formulation containing no non-ionic emulsifier and candle base formulation containing 0.5% non-ionic emulsifier; 2) candle wick coating formulation containing no non-ionic emulsifier and candle base formulation containing no non-ionic emulsifier; 3) candle wick coating formulation containing 10% non-ionic emulsifier and candle base formulation containing no non-ionic emulsifier; and 4) candle wick coating formulation containing 30% non-ionic emulsifier and candle base formulation containing no non-ionic emulsifier.

FIG. 5 shows that adding more non-ionic emulsifier to the candle wick coating formulation does not always increase the mean flame height of the candle. Rather, there is an optimum level of non-ionic emulsifier that can be used in the candle wick coating formulation to provide desired flame height properties.

FIG. 5 also shows that comparable flame height characteristics can be achieved by disposing a relatively high percentage dosage of non-ionic emulsifier in the candle wick coating formulation or by using a relatively small percentage dosage of non-ionic emulsifier in the candle base formulation. On a per candle basis, the absolute amount of non-ionic emulsifier used in the wick coating formulation is substantially less than the amount of non-ionic emulsifier added to the candle base formulation.

Example 3

Formulations containing either Black Pepper Bergamot or Japanese Cherry Blossom as the fragrance component were tested to investiage mean flame height as a function of the non-ionic emulsifier contained in the candle wick coating formulation and in the base candle formulation.

Figure 6:
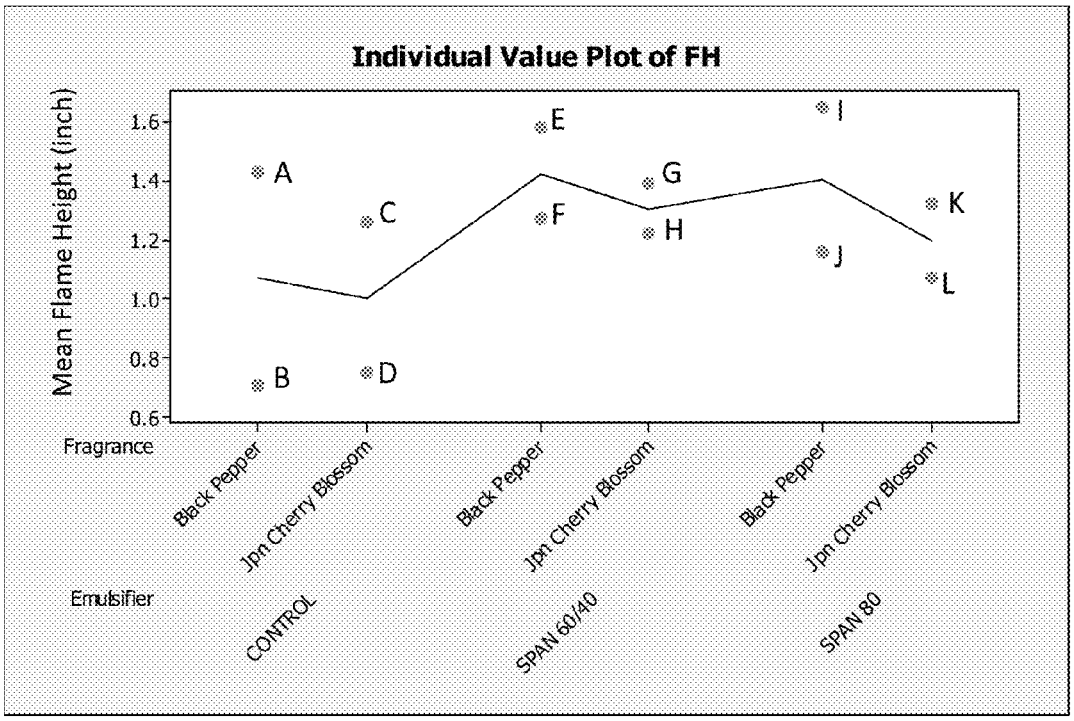
FIG. 6 shows data for 3-wick candles with different fragrance components and different non-ionic emulsifiers.

FIG. 6 shows data for an experiment that measured effects of two variables on candle mean flame height. For fragrance variables there are two levels: Black Pepper Bergamot and Japanese Cherry Blossom. For emulsifiers there are three levels: Control (no emulsifier); SPAN 60/40; and SPAN 80. All the combinations are listed and labeled accordingly in Table 2 below and in FIG. 6.

All emulsifiers were added to the candle base formulation. The fragrance load was 10% in each case. The vertical data compares "before fragrance addition" which are A, C, E, G, I, and K with their pairing counterparts of "after fragrance addition," which are B, D, F, H, J, and L. The data show that adding fragrances into candle base waxes causes the candle mean flame height to drop. Without the addition of one or more appropriate non-ionic emulsifiers, there is a relatively dramatic drop in the mean flame height. By adding appropriate non-ionic emulsifier, such as SPAN 60/40 or SPAN 80, the drop in the mean flame height is substantially reduced. This demonstrates the enhancement in flame height properties due to an appropriate non-ionic emulsifier.

TABLE 2

| | Mean Flame Height (Data Label) | | | |
|---|---|---|---|---|
| | Black Pepper | | Jpn Cherry Blossom | |
| | 0% | 10% | 0% | 10% |
| Control (No Emulsifier) | 1.43" (A) | 0.70" (B) | 1.25" (C) | 0.75" (D) |
| SPAN 60/40 Mixture | 1.57" (E) | 1.26" (F) | 1.41" (G) | 1.22" (H) |
| SPAN 80 | 1.63" (I) | 1.18" (J) | 1.32" (K) | 1.09" (L) |

Example 4

In this set of experiments the impact of the SPAN 80 emulsifier component on candle burn performance was evaluated for several wick wax compositions comprising an emulsifier component. Wicks containing the exemplified wick wax compositions were then evaluated for burn performance in candles where the candle wax comprised the identified fragrance component. The burn performance was characterized as a function of the mean flame heights achieved over a period of time for the population of samples tested for each wick wax formulation and fragrance.

The candle waxes did not contain a non-ionic emulsifier. Each candle wax contained the same weight percentage of fragrance component. The wicks were impregnated/coated with a wick wax that contained the noted weight percentage of a non-ionic emulsifier (SPAN 80). The specific amount of emulsifier and the selected fragrance used in the corresponding candle wax composition is set forth in Table 3 below. The fragrance component used in the candle wax compositions were Japanese Cherry Blossom (JCB), Winter (W), Leaves (L) or Beach Cabana (BC).

Table 3 illustrates the flame performance for each wick wax composition and fragrance component combination that was tested. Specifically, the data in Table 3 show that a wick wax comprising SPAN 80 increases the mean flame height of candles with a fragrance component. An increase in flame height is desired in these types of candles. The addition of an emulsifier, such as SPAN 80, in a wick wax can increase the mean flame height of candles with a candle wax comprising a fragrance component.

TABLE 3

| Test No. | Non-Ionic Emulsifier | Non-Ionic Emulsifier weight % (in wick wax) | HLB | Frag. | Mean FH (inch) |
|---|---|---|---|---|---|
| 1 | Single Blank (Control) | 0.0 | N/A | L | 1.10 |

TABLE 3-continued

| Test No. | Non-Ionic Emulsifier | Non-Ionic Emulsifier weight % (in wick wax) | HLB | Frag. | Mean FH (inch) |
|---|---|---|---|---|---|
| 2 | SPAN 80 | 5.0 | 4.3 | L | 1.18 |
| 3 | SPAN 80 | 10.0 | 4.3 | L | 1.12 |
| 4 | SPAN 80 | 15.0 | 4.3 | L | 1.37 |
| 5 | Single Blank (Control) | 0.00 | N/A | JCB | 0.46 |
| 6 | SPAN 80 | 5.0 | 4.3 | JCB | 0.88 |
| 7 | SPAN 80 | 10.0 | 4.3 | JCB | 0.91 |

OTHER EMBODIMENTS

While certain embodiments are described above, other embodiments may be used.

As an example, while embodiments have been described in which the candle base formulation contains a non-ionic emulsifier and the wick coating formulation contains a non-ionic emulsifier, other embodiments are possible. As an example, the candle base formulation may contain a non-ionic emulsifier while the wick coating formulation does not contain a non-ionic emulsifier. As another example, the wick coating formulation may contain a non-ionic emulsifier while the candle base formulation does not contain a non-ionic emulsifier.

In some embodiments, the candle base formulation contains a plurality of non-ionic emulsifiers, and the wick coating formulation contains at most one non-ionic emulsifiers. In certain embodiments, the wick coating formulation contains a plurality of non-ionic emulsifiers, and the candle base formulation contains at most one non-ionic emulsifier. Optionally, the candle base formulation contains a plurality of non-ionic emulsifiers, and the wick coating formulation contains a plurality of non-ionic emulsifiers. In such embodiments, the candle base formulation may contain one or more non-ionic emulsifiers which are the same as one or more non-ionic emulsifiers contained in the wick coating formulation, and/or the candle base formulation may contain one or more non-ionic emulsifiers which are different from one or more non-ionic emulsifiers contained in the wick coating formulation.

In general, in an embodiment in which a candle base formulation contains more than one non-ionic emulsifier, the candle base formulation contains a total amount of the non-ionic emulsifiers of from 0.1 weight percent one weight percent (e.g., from 0.2 weight percent of the non-ionic emulsifier to one weight percent of the non-ionic emulsifier, 0.5 weight percent of the non-ionic emulsifier).

Generally, in an embodiment in which a wick coating formulation contains more than one non-ionic emulsifier, the wick coating formulation contains a total amount of the non-ionic emulsifiers of at least five weight percent (e.g., at least 10 weight percent, at least 25 weight percent), and/or at most 50 weight percent (e.g., at most 40 weight percent).

Other embodiments are encompassed within the claims.

What is claimed is:

1. A candle, comprising:

a candle base comprising a candle base formulation, the candle base formulation comprising a first non-ionic emulsifier; and a candle wick, comprising:

a capillary member; and a candle wick coating formulation, comprising:

a first wax; and a second non-ionic emulsifier, wherein the first wax is at least partially disposed on the capillary member and in the capillary member, and the candle has a minimum mean flame height of at least one quarter inch.

2. The candle of claim 1, wherein the candle has a minimum mean flame height of at least one half inch.

3. The candle of claim 1, wherein the candle base formulation further comprises a second wax, the second wax is different from the first wax, and the second non-ionic emulsifier is different from the first non-ionic emulsifier.

4. The candle of claim 1, wherein the candle base formulation further comprises the first wax, and the second non-ionic emulsifier is different from the first non-ionic emulsifier.

5. The candle of claim 1, wherein the candle base formulation comprises the first wax and the first non-ionic emulsifier is the same as the second non-ionic emulsifier.

6. The candle of claim 1, wherein the first non-ionic emulsifier is completely dispersed at a temperature between 25° C. and 100° C.

7. The candle of claim 1, wherein the candle comprises a fragrance component.

8. The candle of claim 1, wherein the candle wick coating formulation comprises at least five weight percent of the second non-ionic emulsifier.

9. The candle of claim 1, wherein the candle wick coating formulation comprises at least 10 weight percent of the second non-ionic emulsifier.

10. The candle of claim 1, wherein the candle wick coating formulation comprises at least 25 weight percent of the second non-ionic emulsifier.

11. The candle of claim 1, wherein the candle wick coating formulation comprises at most 50 weight percent of the second non-ionic emulsifier.

12. The candle of claim 3, wherein the candle comprises a fragrance component.

13. The candle of claim 4, wherein the candle comprises a fragrance component.

14. The candle of claim 5, wherein the candle comprises a fragrance component.

15. A candle, comprising:

a candle base comprising a candle base formulation, the candle base formulation comprising a first non-ionic emulsifier; and a candle wick, comprising:

a capillary member; and a candle wick coating formulation, comprising:

a first wax; and a second non-ionic emulsifier, wherein the first wax is at least partially disposed on the capillary member and in the capillary member, and the candle has a minimum mean flame height that is at least 0.1 inch higher than that of an otherwise identical candle without the non-ionic emulsifier.

16. The candle of claim 15, wherein the candle has a minimum mean flame height that is at least 0.2 inch higher than that of an otherwise identical candle without the non-ionic emulsifier.

17. The candle of claim 15, wherein the candle has a maximum flame height that is at most one inch higher than that of an otherwise identical candle without the non-ionic emulsifier.

18. The candle of claim 15, wherein the candle base formulation comprises a second wax, the second wax is different from the first wax, and the second non-ionic emulsifier is different from the first non-ionic emulsifier.

19. The candle of claim 15, wherein the candle base formulation comprises the first wax, and the second non-ionic emulsifier is different from the first non-ionic emulsifier.

20. The candle of claim 15, wherein the candle base formulation comprises the first wax, and the first non-ionic emulsifier is the same as the second non-ionic emulsifiers.

21. The candle of claim 15, wherein the second non-ionic emulsifier is completely dispersed at a temperature between 25° C. and 100° C.

22. The candle of claim 15, wherein the candle comprises a fragrance component.

23. The candle of claim 15, wherein the candle wick coating formulation comprises at least five weight percent of the second non-ionic emulsifier.

24. The candle of claim 15, wherein the candle wick coating formulation comprises at least 10 weight percent of the second non-ionic emulsifier.

25. The candle of claim 15, wherein the candle wick coating formulation comprises at least 25 weight percent of the second non-ionic emulsifier.

26. The candle of claim 15, wherein the candle wick coating formulation comprises at most 50 weight percent of second first non-ionic emulsifier.

27. The candle of claim 18, wherein the candle comprises a fragrance component.

28. The candle of claim 19, wherein the candle comprises a fragrance component.

29. The candle of claim 20, wherein the candle comprises a fragrance component.

* * * * *